US005766421A

United States Patent [19]

Aufrecht

[11] Patent Number: 5,766,421

[45] Date of Patent: Jun. 16, 1998

[54] EXTENDED NIP PRESS BLANKET

[75] Inventor: Harald Aufrecht, Aalen, Germany

[73] Assignee: Voith Sulzer Papiermaschinen Gesellschaft mbH, Germany

[21] Appl. No.: 562,694

[22] Filed: Nov. 27, 1995

[30] Foreign Application Priority Data

Dec. 7, 1994 [DE] Germany ..... 44 43 598.3

[51] Int. Cl.[6] ..... D21F 3/02

[52] U.S. Cl. ..... 162/358.4; 162/901; 198/847; 264/347

[58] Field of Search ..... 162/358.4, 901; 264/236, 327, 347, 171.24; 198/847

[56] References Cited

U.S. PATENT DOCUMENTS

| | | | |
|---|---|---|---|
| 2,618,812 | 11/1952 | Hulswit | 264/327 |
| 4,330,023 | 5/1982 | Cronin | 162/388.4 |
| 4,482,430 | 11/1984 | Majanismi | 162/358.4 |
| 4,559,106 | 12/1985 | Skytta et al. | 162/358.3 |
| 4,635,618 | 1/1987 | Munz | 128/24 R |
| 4,978,428 | 12/1990 | Cronin et al. | 162/358.4 |
| 5,062,924 | 11/1991 | McCarten et al. | 162/358.4 |
| 5,118,391 | 6/1992 | Matuschczyk et al. | 162/358.4 |
| 5,134,010 | 7/1992 | Schiel | 162/901 |
| 5,390,011 | 2/1995 | Theodoulou | 355/272 |

FOREIGN PATENT DOCUMENTS

| | | |
|---|---|---|
| 40 22 800 | 9/1991 | Germany . |
| 2106555 | 4/1983 | United Kingdom . |
| WO 92/02678 | 2/1992 | WIPO . |

*Primary Examiner*—Karen M. Hastings

*Attorney, Agent, or Firm*—Pretty, Schroeder & Poplawski

[57] ABSTRACT

A press blanket in a pressing device intended for extracting water from a web in the press nip of a papermaking machine comprises an elastomeric matrix, in which the outer area, facing the web, is subjected to a thermal treatment in order to increase the wear-resistance. Although the elastomeric matrix thus consists of the same material throughout, the outer area, which is subjected to greater stresses, therefore exhibits increased wear-resistance. The press blanket is made in a single operation, by casting a hot-casting elastomeric matrix onto a cylindrical casting mold, while at the same time reinforcing threads are wound into the material. The press blanket is selectively thermally treated in order to achieve increased wear-resistance at the outer surface facing the web to a depth below the depth of grooves or bores on this outer surface.

3 Claims, 1 Drawing Sheet

EXTENDED NIP PRESS BLANKET

BACKGROUND OF THE INVENTION

The present invention relates to a press blanket for extracting water from a web in a press nip of a papermaking machine, having an elastomeric matrix material in which reinforcing threads are embedded and in which the outer range which faces the web, as well as the inner range opposite the web is made from a hot-casting matrix material and produced in a single operation. After casting the matrix material is thermally cured.

The invention further relates to a method of making a press blanket for a pressing device intended for extracting water from a web passing through a press nip in a papermaking machine, in which an elastomeric curable matrix material is cast onto a casting mold, while reinforcing threads are simultaneously wound in. Thereafter the matrix material is thermally cured.

A press blanket and a pressing device of the aforementioned kind are known from U.S. Pat. No. 5,062,924. Accordingly, a press blanket is produced by simultaneously saturating a woven base on both sides thereof with polyurethane. The saturated woven base is then wrapped around a smooth mandrel. Thereafter, the wrapped mandrel is heated such that the polyurethane gels. Finally, the wrapped mandrel is further heat treated within a heating of oven for curing the polyurethane. Finally, the cured blanket is cooled and ground at the surface to a uniform thickness. In addition, grooves or blind bores may be provided on the outer surface of the blanket.

Press blankets of this kind are used especially in pressing devices of papermaking machines in order to extract water from a continuous pulp mat, a water-containing web. Such a pressing device comprises two press elements (for example two press rolls or a press roll and a press shoe), that form together a press nip. The web, from which the water is to be extracted, passes through this press nip, together with the press blanket and, in some cases, together with one or two felts. As a rule, the press blanket is endless and may have different lengths, in the traveling direction of the web. In the case of long press blankets, as disclosed for example by GB 2,106,555, the press blanket runs about guide rolls outside the press nip. If, however, the press blanket is relatively short in the direction of movement, then it forms a hose-shaped press blanket moving along a substantially circular path outside the press nip.

Press blankets of this kind are exposed to high stresses in operation. In the press nip they are subjected to high pressures and fulling stresses that may cause premature wear of the press blanket. Especially on the surface of the press blanket that faces the web, considerable abrasion occurs. In the case of conventional rolls this has the effect that the compression of the press blanket in the press nip and, thus, the water extraction efficiency will vary. For press blankets intended for shoe presses, such circumstance will result in changes in the distribution of pressure and also in variations in the water extraction behavior.

In addition, grooved press blankets have become known (U.S. Pat. No. 4,559,106, WO 92/02678, U.S. Pat. No. 4,478,428, U.S. Pat. No. 5,062,924) which are intended to improve the absorptive capacity in the area of the press nip. Such grooved press blankets are likewise subjected to the same stresses that have been described before, so that as a result of the reduced strength brought about by the grooves, and due to the higher tensile strains and shearing stresses encountered in the area of the grooves, an even higher degree of wear occurs in the area of the grooves, which is connected with the before-mentioned disadvantages.

It was for this reason that U.S. Pat. No. 4,978,428 proposed an outer wear-resisting layer facing the web, whose hardness exceeds that of the next lower layer. It has been found that in the case of such a design, where a layer of greater hardness is arranged on a layer of lesser hardness, there is a risk that the two layers may get detached one from the other and, thus, a risk of destruction of the press blanket.

Now, it is an object of the present invention to provide an improved press blanket which avoids the disadvantages of the prior art and which, in particular, offers long service life and little abrasion.

It is a further object of the invention to provide a suitable method for producing such a press blanket.

SUMMARY OF THE INVENTION

With respect to the press blanket, this object is achieved by the fact that in the case of the press blanket of the afore-mentioned type both the outer area and the inner area, opposite the web, are made from a hot-casting matrix material and produced in a single operation, and that the outer press blanket is subjected to a thermal treatment in order to cure the matrix material, wherein a temperature gradient is kept leading from a higher temperature at the outer surface, which is intended for facing the web during operation, to a lower temperature at the opposite inner surface. This heat treatment is performed for a sufficient time to yield an increased cross-linkage at the outer surface leading to a higher surface hardness than at the inner surface.

While according to the prior art increased wear-resistance of the outer area, that faces the web and that is subjected to the higher stresses, is obtained by the use of a matrix material of greater hardness and wear-resistance, increased wear-resistance and increased hardness and toughness of the outer area of the press blanket, i.e. in the area exposed to the higher stresses, is achieved solely by a thermal treatment. In contrast, increased elasticity is achieved for the inner area since here a lesser degree of cross-linking occurs, compared with the outer area.

According to the present invention, the press jacket therefore consists of the same matrix material throughout. Disintegration phenomena of the kind encountered with conventional press blankets, due to the use of matrix materials of different hardness, toughness, or the like for the outer and the inner areas, respectively, are thus safely prevented. At the same time, especially an increased wear-resistance can be achieved by selective thermal treatment, which simultaneously results in greater hardness and toughness. It is thus possible to selectively improve the mechanical properties of the outer area of the press blanket by means of the thermal treatment, which preferably is limited to the pressing zone of the press blanket running through the press nip. The additional thermal treatment leads in this area to a higher degree of cross-linking of the elastomeric matrix material, which in turn results in improved mechanical properties. Due to the fact that the press blanket consists of the same matrix base material throughout, any disintegration phenomena between the outer, thermally treated area and the inner, not thermally treated area are safely prevented.

The matrix material used in this case is a hot-casting material, preferably a hot-casting polyurethane.

A press blanket according to the invention, therefore, provides considerably prolonged service life, compared with conventional press blankets, and guarantees at the same time a high degree of operating safety.

In the case of press blankets, which are provided with grooves or blind bores in their pressing zone in order to provide additional water-absorbing capacity, the outer, thermally treated area having increased cross-linkage extends at least down to the same depth as the grooves or blind bores.

This has the effect that the whole area of the press blanket, that is exposed to higher stresses, is given improved wear-resistance, hardness and toughness. This is of particular importance insofar as increased strains will occur in the area of the grooves due to notch stresses.

Preferably, the thermal treatment is controlled in such a way that only the outer area will be cured while the inner area is practically excluded from the thermal treatment so that in this area a lesser degree of cross-linking will occur which will result in greater elasticity in this area, whereas greater wear-resistance is achieved in the outer area.

The depth of the outer area, up to which this increased wear-resistance of the matrix material is achieved, is controlled especially by the duration of the thermal treatment at a predetermined temperature.

According to a preferred further improvement of the invention, the area having increased cross-linkage extends only over a pressing zone defined on both sides by the two lateral marginal areas of the press blanket.

It is thus ensured that the press blanket offers high strength in the marginal areas in order to enable the press blanket to be driven via the carrying disks, while sufficient elasticity is retained for permitting the blanket to be secured on the carrying disks, whereas on the other hand the necessary increase in wear resistance, combined with a simultaneous increase in hardness and toughness of the material, is effected only in the central pressing zone of the press blanket.

The production method known from the prior art (U.S. Pat. No. 5,118,391 which is fully incorporated by reference) is supplemented by a selective thermal treatment, following the casting process, which is intended to increase the wear resistance only of the outer area of the press blanket facing the web.

A further improvement of the method according to the invention, where grooves or blind bores are drilled into outer face of the press blanket, i.e. the side facing the web, after curing of the matrix material, provides that the thermal treatment is effected to the point that increased cross-linkage and wear-resistance resulting from the thermal treatment is obtained at least down to the depth to which the grooves or blind bores extend.

This ensures that the whole area of the press blanket, which is subjected to increased stresses, is given greater wear-resistance. Preferably, the thermal treatment is even advanced to a depth exceeding the depth of the grooves or blind bores, as increased notch stresses may occur especially at the bottom of the grooves or blind bores so that the increase in strength may prove to be of advantage even in an area slightly below the grooves or blind bores.

The thermal treatment is controlled in such a way as to spare the inner area. This ensures that higher elasticity is retained in the inner area, which is of advantage for the service life of the press blanket. Preferably, the press blanket is subjected to the action of heat over a period of approximately 6 to 16 hours in a manner such that its surface assumes a temperature of approximately 60° C. to 120° C. In the case of a press blanket of approximately 5 mm thickness, a treatment time of approximately 8 to 14 hours, in particular a treatment time of 9 to 11 hours, has proved to be particularly advantageous, at a surface temperature of approximately 70° C. to 100° C., in particular 80° C. to 90° C.

It is understood that the features mentioned above and those yet to be explained below can be used not only in the respective combinations indicated, but also in other combinations or in isolation, without leaving the scope of the present invention.

SHORT DESCRIPTION OF THE DRAWINGS

Further features and advantages will become apparent from the following description of certain preferred embodiments of the invention. In the drawings.

DETAILED DESCRIPTION OF THE PREFERRED EMBODIMENT

Figure 1:
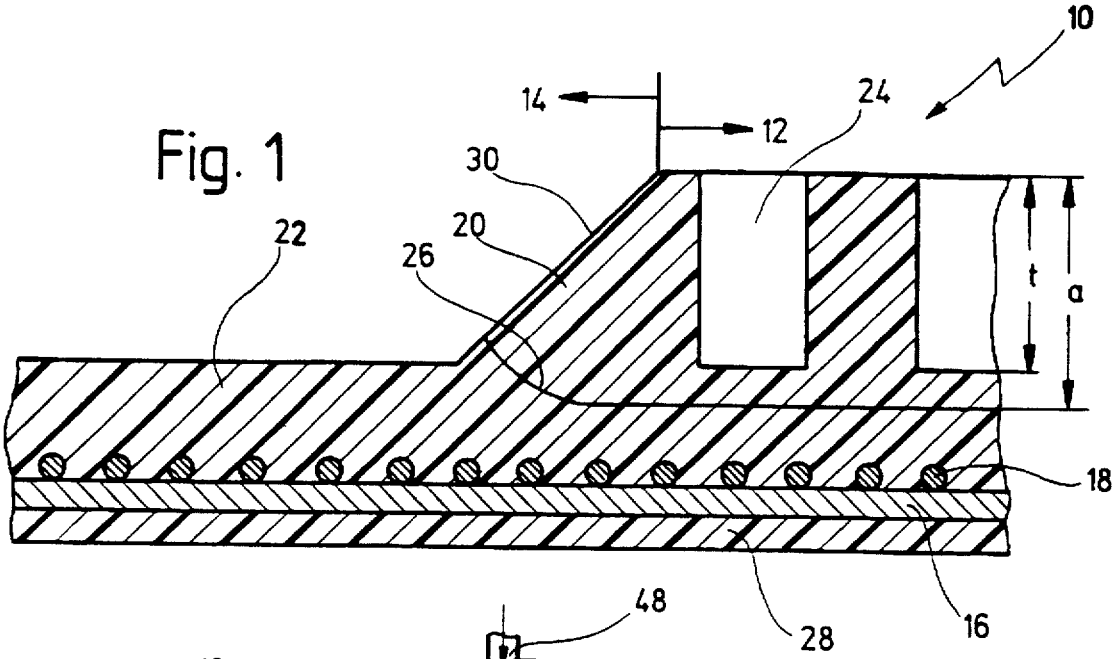
FIG. 1 shows a cross-section through part of a press blanket according to the invention.

In FIG. 1, a press blanket according to the invention is generally indicated by reference numeral 10.

Figure 3:
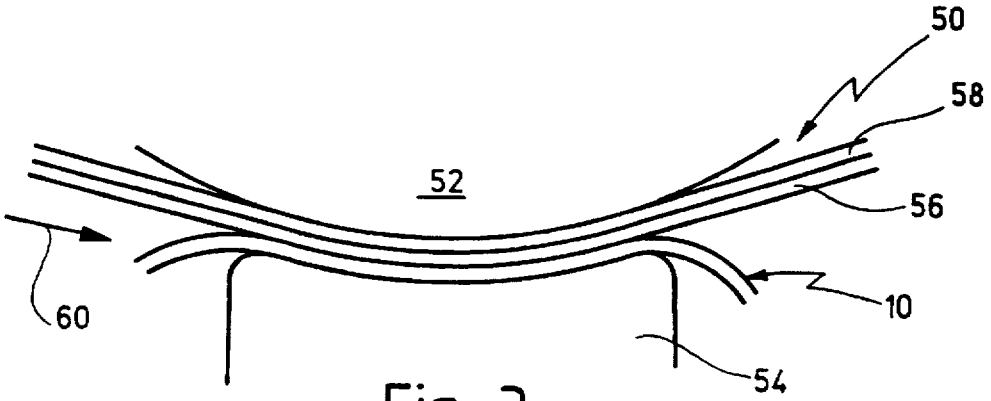
FIG. 3 shows a simplified representation of a pressing device in the area of the press nip.

FIG. 3 is a diagrammatic representation of the conditions existing at a press nip 50 of a shoe press of conventional design, where the press blanket 10 revolves about a press shoe 54 that forms a press nip 50 with a back-up roll 52. A pulp web in the form a water-containing web 58 is guided between the back-up roll 52 and a felt 56 that runs above the press blanket 10. Due to a high pressure prevailing in the press nip 50, the water is extracted from the web 58 in the press nip 50 and is absorbed by the felt 56 and/or taken up by the grooves in the press blanket.

According to FIG. 1, the press blanket 10 is configured as an endless hose-shaped web, with increased thickness in its central area, i.e. the press zone 12.

The press blanket 10 comprises an elastomeric matrix 28 consisting of a hot-casting polyurethane. The elastomeric matrix is reinforced by reinforcing threads 16, 18 that give the press blanket the required stability.

Figure 2:
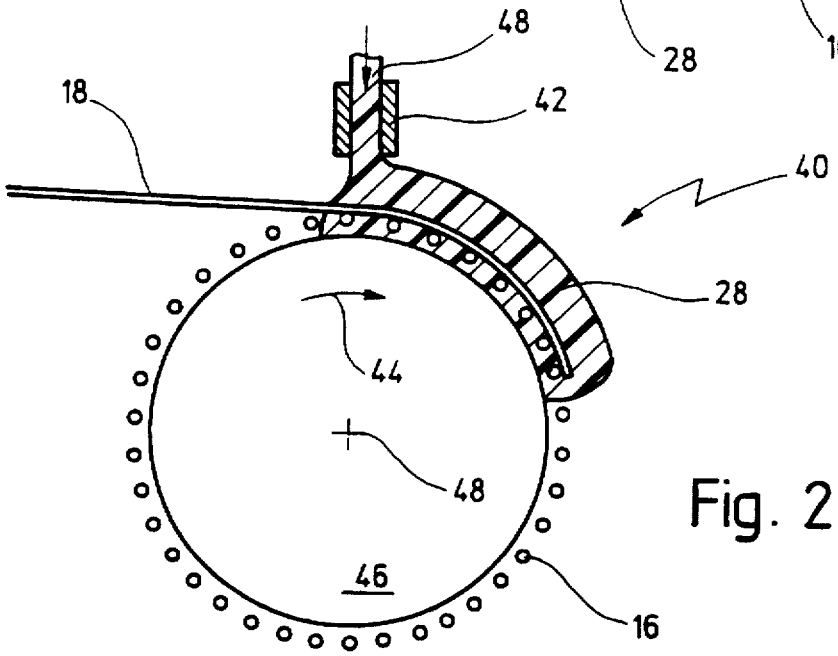
FIG. 2 shows a simplified diagrammatic sectional representation, not to scale, of a device for producing a press blanket.

The reinforcing threads 16, 18 consist of radially inner, mutually parallel axial threads 16, facing away from the web 58 and extending at equal spacings in crosswise direction between the edges of the press blanket 10, and of longitudinal threads 18 extending transversely thereto, i.e. substantially in the direction of movement 60—as viewed in FIG. 3—of the web, which longitudinal threads are spirally wound above the axial threads 16, as will be described in more detail below, with reference to FIG. 2.

On either side of the press blanket 10, the marginal area 14 is followed, via an oblique section 30, by the press zone 12 of the press blanket, which runs through the press nip 50 during use of the press blanket 10, and in which the elastomeric matrix 28 is present in considerably greater thickness above the reinforcing threads 16, 18, i.e. on the side facing the web 58.

Further, grooves 24 of rectangular cross-section, that serve for taking up the water extracted in the press nip 50, extend in the press zone 12 at equal spacings one from the other in the longitudinal direction of the press blanket 10, i.e. in the direction of movement of the web 60. Alternatively, the base of the grooves may be rounded.

The grooves 24 extend over the full width of the press zone 12, at equal spacings one from the other, and down to a depth t.

The outer area 20 of the press blanket 10, facing the web 58, has been subjected to a thermal treatment intended to increase the wear-resistance of the matrix 28. The thermally treated area 20 extends over the full width of the press zone 12 and laterally up to a marginal area 14. A temperature gradient leading from the outer area facing the web to the inner area opposite the web is selected such that cross-linkage of the material within the inner area is virtually unaffected by the thermal treatment. The thermally treated area 20 having increased cross-linkage is separated from the untreated area by a boundary layer 26. The boundary layer 26 extends somewhat below the lower end of the grooves 24, which means that the depth of the thermally treated area a exceeds the depth of the grooves t. The thermally treated area 20 with increased cross-linkage distinguishes itself by increased wear-resistance which results in improved service life of the press blanket 10, and this especially in the area of the press blanket that is exposed to the increased stresses in operation. Simultaneously, sufficient strength is guaranteed in the area below the end of the grooves 24, where increased stresses are encountered as a result of notch effects. It is understood that instead of providing grooves, blind bores may be disposed according to a predetermined bore pattern.

The press blanket is produced in the conventional manner as described in detail in U.S. Pat. No. 5,134,010 which is fully incorporated by reference.

A device 40 for the production of the press blanket 10 comprises a cylindrical casting mold 46 with two end faces between which the axial threads are stretched in mutually parallel arrangement and at a predetermined distance from the surface. The polyurethane is fed from above at increased temperature through a line 48 and through a first casting nozzle 42, while the casting mold 46 is rotated about its central axis 48, in the direction indicated by arrow 44, and the casting nozzle 42 is advanced by means of a slide in a direction parallel to the central axis 48 so that gradually a cylindrical press blanket is produced by the continuous casting process. During the process, the compound flows through the axial threads 16 and down onto the casting mold 46, thereby forming the elastomeric matrix 28 of the press blanket.

At the same time, a longitudinal thread 18 is spirally wound into the compound, resting on the outside of the axial threads 16.

As a result of this process, the press blanket 10 is produced in the known manner.

Thereafter, grooves 24 are brought down to a depth t in the longitudinal direction of the press blanket 10 and at equal spacings one from the other. According to the invention, the press blanket 10 is then subjected to a selective thermal treatment over the full width of the press area, down to a depth a somewhat greater than the depth t of the grooves 24, whereby the wear-resistance of the elastomeric matrix is improved in this area due to the fact that the degree of cross-linking of the elastomeric matrix 28 is increased. This can be effected, for example, by a radiator.

When the press blanket has a thickness of approximately 5 mm and a hot-casting polyurethane is used, a duration of the thermal treatment of approximately 8 to 14 hours, preferably approximately 10 hours, has proved to be particularly advantageous; the temperature is controlled in this case in such a way that a temperature of approximately 60° C. to 120° C., preferably 80° C. to 90° C., is obtained at the surface of the press blanket.

For optimum performance, the thermal treatment is selected to yield a surface hardness of at least 95 Shore-A at the outer surface and a surface hardness between 85 and 95 Shore-A at the inner surface of the press blanket.

It is understood that the range of increased surface hardness may reach down to a greater depth, i.e. down to the reinforcing threads or even beyond the latter.

I claim:

1. An endless impermeable press blanket in a pressing device in which said press blanket, a web, and at least one felt pass through an extended press nip defined by a rotatable press roll and a cooperating loaded press shoe for extracting water from said web in said extended press nip, said press blanket comprising:

an elastomeric matrix made integrally from a hot casting material in a single operation, said press blanket comprising an inner surface which cooperates with said press shoe and an outer surface opposite said inner surface, one of grooves or bores provided on said outer surface; and a plurality of reinforcing threads embedded within said elastomeric matrix;

said elastomeric matrix having been selectively thermally cured for having a cross linkage greater at said outer surface than at said inner surface wherein said thermally cured elastomeric matrix extends below the depth of the grooves or bores;

said elastomeric matrix having a shore hardness at said outer surface which is greater than said shore hardness at said inner surface.

2. The press blanket of claim 1, wherein the shore hardness is at least 95 Shore-A at said outer surface.

3. The press blanket of claim 1, wherein the shore hardness is between 85 and 95 Shore-A at said inner surface.

* * * * *